US008231151B2

(12) United States Patent
Barrieau

(10) Patent No.: US 8,231,151 B2
(45) Date of Patent: Jul. 31, 2012

(54) MAGNETIC RELEASING AND SECURING DEVICE

(75) Inventor: Mark P. Barrieau, Baldwinville, MA (US)

(73) Assignee: SimplexGrinnell LP, Westminster, MA (US)

( * ) Notice: Subject to any disclaimer, the term of this patent is extended or adjusted under 35 U.S.C. 154(b) by 450 days.

(21) Appl. No.: 12/437,428

(22) Filed: May 7, 2009

(65) Prior Publication Data

US 2010/0281933 A1 Nov. 11, 2010

(51) Int. Cl.

| | |
|---|---|
| ***E05C 17/56*** | (2006.01) |
| ***E05C 1/06*** | (2006.01) |
| ***E05C 1/02*** | (2006.01) |
| ***E05B 47/00*** | (2006.01) |
| ***E05B 15/00*** | (2006.01) |

(52) U.S. Cl. ..... 292/251.5; 292/144; 292/137; 292/138; 70/277; 70/266

(58) Field of Classification Search ..... 292/251.5, 292/144, 137, 138, DIG. 15; 70/277, 266–271, 70/DIG. 49

See application file for complete search history.

(56) References Cited

U.S. PATENT DOCUMENTS

| | | | | |
|---|---|---|---|---|
| 3,795,771 | A * | 3/1974 | Gundersen et al. | 370/242 |
| 4,682,801 | A * | 7/1987 | Cook et al. | 292/251.5 |
| 5,216,909 | A * | 6/1993 | Armoogam | 70/278.7 |
| 5,293,020 | A * | 3/1994 | Han et al. | 219/724 |
| 5,429,399 | A * | 7/1995 | Geringer et al. | 292/92 |
| 5,617,082 | A | 4/1997 | Denison et al. | 340/825.31 |
| 6,049,287 | A * | 4/2000 | Yulkowski | 340/693.12 |
| 6,104,594 | A * | 8/2000 | Frolov et al. | 361/152 |
| 6,359,547 | B1 | 3/2002 | Denison et al. | 340/825.31 |
| 6,426,697 | B1 | 7/2002 | Capowski et al. | 304/506 |
| 6,611,414 | B1 * | 8/2003 | Lavelle et al. | 361/154 |
| 6,746,091 | B2 * | 6/2004 | Friar et al. | 312/218 |
| 6,948,685 | B2 * | 9/2005 | Hawthorne | 244/129.1 |
| 6,965,294 | B1 * | 11/2005 | Elliott et al. | 340/5.2 |
| 2007/0214725 | A1 * | 9/2007 | Miyashita | 49/340 |

* cited by examiner

*Primary Examiner* — Thomas Beach
*Assistant Examiner* — Nathan Cumar
(74) *Attorney, Agent, or Firm* — Brinks Hofer Gilson & Lione

(57) ABSTRACT

A system for securing and releasing doors includes at least two electromagnetic latches and a controller. Each of the electromagnetic latches includes a coil configured to be energized by a power signal to create a magnetic field. The controller switches the power signal between the electromagnetic latches so that the power signal is supplied to the electromagnetic latches one at a time. The electromagnetic latches may be electromagnetic door holders, electromagnetic door locks, or any combination of the two.

23 Claims, 7 Drawing Sheets

MAGNETIC RELEASING AND SECURING DEVICE

BACKGROUND

Passive fire protection refers to the protection built into the design of a building to defend against the threat of fire. An example of passive fire protection involves enclosing areas with fire barriers. Fire barriers formed by fire resistant walls can effectively prevent the spread of fires from one section of a building to another. In this way, only the portion of the building in danger must be evacuated. Other portions separated from the danger by fire barriers will remain safe unless the situation worsens.

Fire doors are used to permit people to pass through a fire resistant wall to travel from one section of a building to another. If a fire door is left open during a fire, there will be a breach in the fire barrier, and the risk of fire spreading across the fire barrier will increase.

Fire doors may be automatically closed in the event of a fire. The fire door is held open by an electronic device during times when a fire condition is not detected. When power to the electronic device is switched off because of a fire, the fire door will close. In addition, emergency doors that normally remain locked by an electronic device may be automatically unlocked in the event of a fire by removing power to the electronic device. Fire doors and emergency doors that include these electronic latching systems require a considerable amount of power because the energized state of the system occurs nearly 100% of the time. A substantial portion of the cost of door holders and door locks is the cost of supplying constant power to the devices.

Further, in the event of a power outage, electronic latching systems often use battery backup systems. Because the standby states of these systems require continuous power possibly for long periods of time, large batteries are required for adequate operation of the battery backup systems.

What is needed is a system of electromagnetic door holder or door locks that conserves power, which will reduce the cost of system and increase the potential standby time for battery powered systems.

SUMMARY OF INVENTION

A system for securing and releasing doors includes at least two electromagnetic latches and a controller. Each of the electromagnetic latches includes a coil configured to be energized by a power signal to create a magnetic field. The controller sequentially applies the power signal to the electromagnetic latches so that the power signal is supplied to only one of the electromagnetic latches at a time. The electromagnetic latches may be electromagnetic door holders, electromagnetic door locks, or any combination of the two.

After the power signal is removed from one of the electromagnetic latches, a sufficient magnetic field remains because a current induced in the coil circulates in a path provided by a coil suppression device. The power signal is reapplied to the electromagnetic latch before the magnetic field significantly dissipates. Therefore, the door holder or door lock can operate normally even though the power signal is not continuously applied.

The electromagnetic latches may be part of an alarm system. The controller communicates with a fire alarm control panel via a network. The alarm system may also include smoke detectors, gas detectors, manual alarm triggers, and notification appliances. The fire alarm control panel may receive an alarm condition from one of the detectors or triggers and send a control signal to the controller of the electromagnetic latches.

The present invention is defined by the following claims, and nothing in this section should be taken as a limitation on those claims. The preferred embodiments will now be described with reference to the attached drawings.

DETAILED DESCRIPTION

The present embodiments relate to systems and methods of magnetic releasing and securing devices. Two possible applications of magnetic releasing and securing devices relating to fire doors include electromagnetic door holders and electromagnetic door locks. These types of electromagnetic latching devices require more energy to activate the magnetic field in the electromagnet or solenoid than to maintain the magnetic field. The difference in the amount of energy required to activate the magnetic field and the amount of energy required to maintain the magnetic field is partially due to a coil suppression diode.

The coil suppression diode slows the release time of the electromagnetic latching device. The coil suppression diode clamps the voltage across the coil in the solenoid or electromagnet at one junction drop above the supply voltage. When the power supply to the coil is interrupted, a transient voltage is generated from the induced current through the coil. The coil suppression diode is used to protect the circuit connected to the solenoid or electromagnet from the transient voltage caused by coil deenergization.

The coil suppression diode is placed across the coil, in the reverse direction of the supply voltage. This provides a path for the current flowing from the deenergized coil to be returned to the coil. The magnitude of the coil induced voltage is limited by the forward drop of the coil suppression diode. Consequently, the decay of the magnetic field is slowed. The slow decay of the magnetic field permits the electromagnet of the solenoid to be maintained in the energized state by further supplying a lower supply voltage than was used to initiate the magnetic field or by pulsing the supply voltage on and off over time. Such pulsing allows the power supply to sequentially, or otherwise, power other devices.

Figure 1:
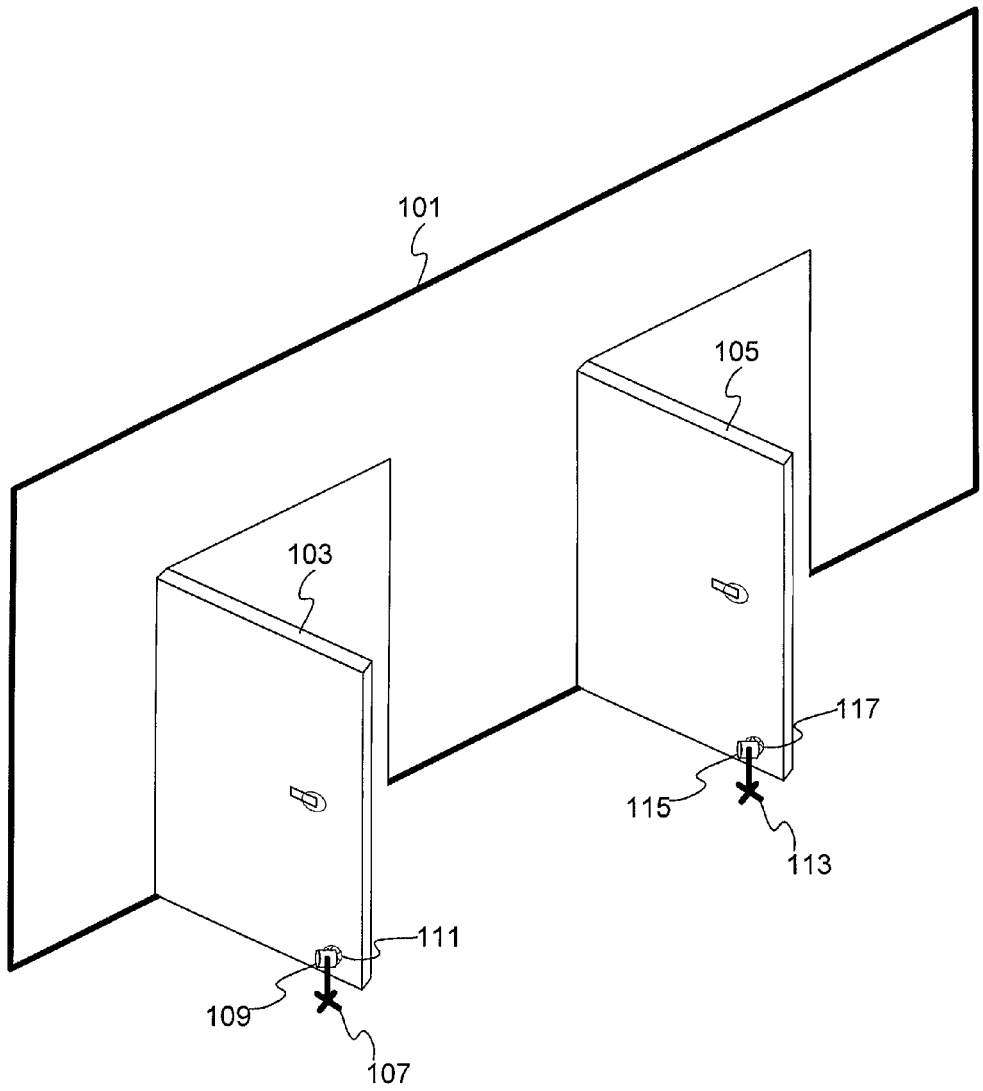
FIG. 1 illustrates an exemplary application of an electromagnetic latching device as an electromagnetic door holder.

FIG. 1 illustrates one application of an electromagnetic latching device as an electromagnetic door holder. An energized electromagnetic door holder holds a door open during normal operation. Wall 101 is a fire resistant wall serving as a fire barrier. In the event of a fire, door 103 and door 105 are allowed to shut to maintain the integrity of a fire barrier. In the open state of door 103, magnetic member 111 is held in place by the magnetic field generated by electromagnet 109. Electromagnet 109 generates a magnetic field when it is energized by a power signal. In the open state of door 105, magnetic member 117 is held in place by the magnetic field generated by electromagnet 115. Supports 107 and 113 support electromagnets 109 and 115. Magnetic members 111 and 117 may be formed of magnets or any ferromagnetic material having an attraction to magnets, such as iron or nickel.

The doors 103 and 105 are shown separated along the same wall for illustrative purposes. Often, doors 103 and 105 will oppose one another to open a large doorway. In that case, electromagnets 109 and 115 are mounted on the nearby walls that are perpendicular to the doorway. As discussed in more detail below, electromagnets 109 and 115 may be powered by a single controller. Optionally, the electromagnets 109 and 115 may have a manual switch located on the device to mechanically turn off power in the case of malfunction, testing or other emergency.

Figure 2A:
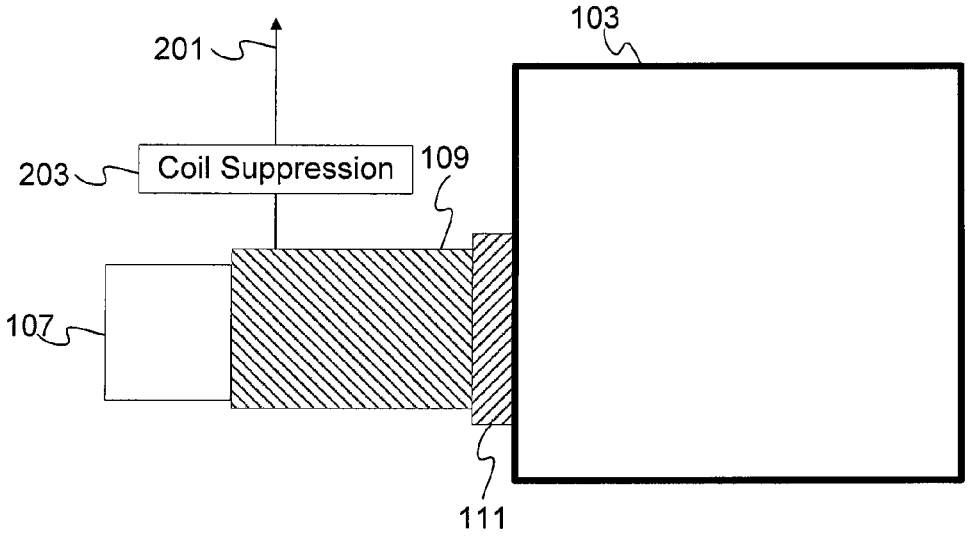
FIG. 2A illustrates the electromagnetic door holder of FIG. 1 with the door in a first position.

FIG. 2A illustrates an electromagnetic door holder in the energized state with door 103 held open. Support 107 supports the electromagnet, and may be connected to the electromagnet 109 through a threaded rod that is pivotable on a ball joint. Magnetic member 111 is secured to door 103 through an adhesive or any suitable fastening member, and may be secured to a steel plate on the door. Magnetic member 111 is optional if the door 103 is constructed of magnetic materials and electromagnet 109 is able to apply sufficient attractive force to hold the door 103 in the open position.

Electromagnet 109 is energized through a power signal delivered by communication line 201. Coil suppression device 203 protects from the transient voltage caused by the induced voltage and slows the decay of the magnetic field. Electromagnet 109 generates a magnetic field which attracts magnetic member 111 and holds the door in the open state. Coil suppression device 203 may be a diode reversed biased by the supply voltage.

Figure 2B:
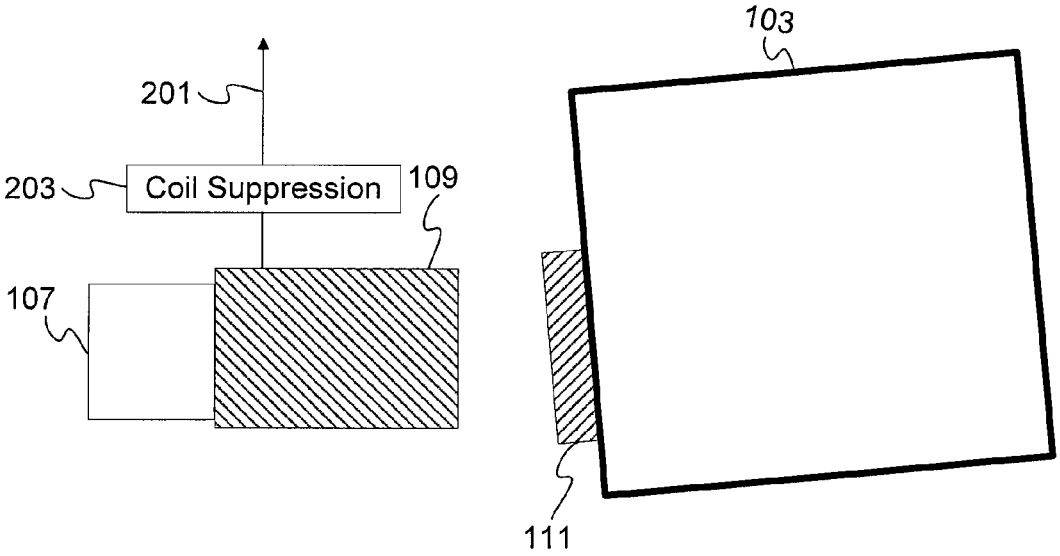
FIG. 2B illustrates an electromagnetic door holder of FIG. 1 with the door in a second position.

FIG. 2B illustrates the electromagnetic door holder of FIG. 2A with door 103 beginning to close. To reach this state, the supply voltage through communication line 201 has stopped for an amount of time long enough for the transient voltage from the electromagnet to decay through coil suppression device 203 to the point that the magnetic force is no longer strong enough to hold magnetic member 111 in contact with electromagnet 109.

Figure 3:
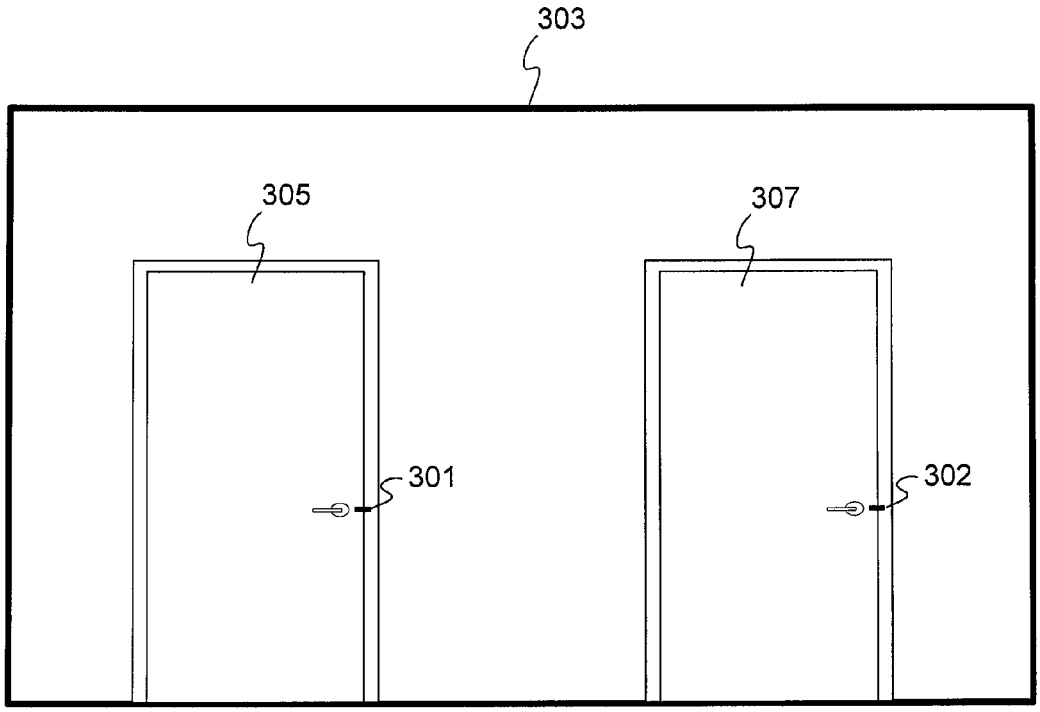
FIG. 3 illustrates an exemplary application of an electromagnetic latching device as a door lock.

FIG. 3 illustrates an exemplary application of an electromagnetic latching device as a door lock. Wall 303 may be a fire resistant wall serving as a fire barrier. Doors 305 and 307 provide access through wall 303. Door 305 includes lock 301, and door 307 includes lock 302.

In some applications, doors 305 and 307 should be locked in the normal state and unlocked in the case of a fire or other event. For example, in many circumstances it is desired for emergency doors to remain locked until an emergency occurs. In other applications, doors 305 and 307 should be unlocked in the normal state and locked in the case of fire or other event. For example, in large buildings fire resistant walls are effective to keep a fire from spreading to other portions of the building. In this case, doors 305 and 307 should be locked in the event of a fire to keep people from entering the portion of the building with the alarm condition and to keep the fire barrier from being compromised by an opening.

Figure 4A:
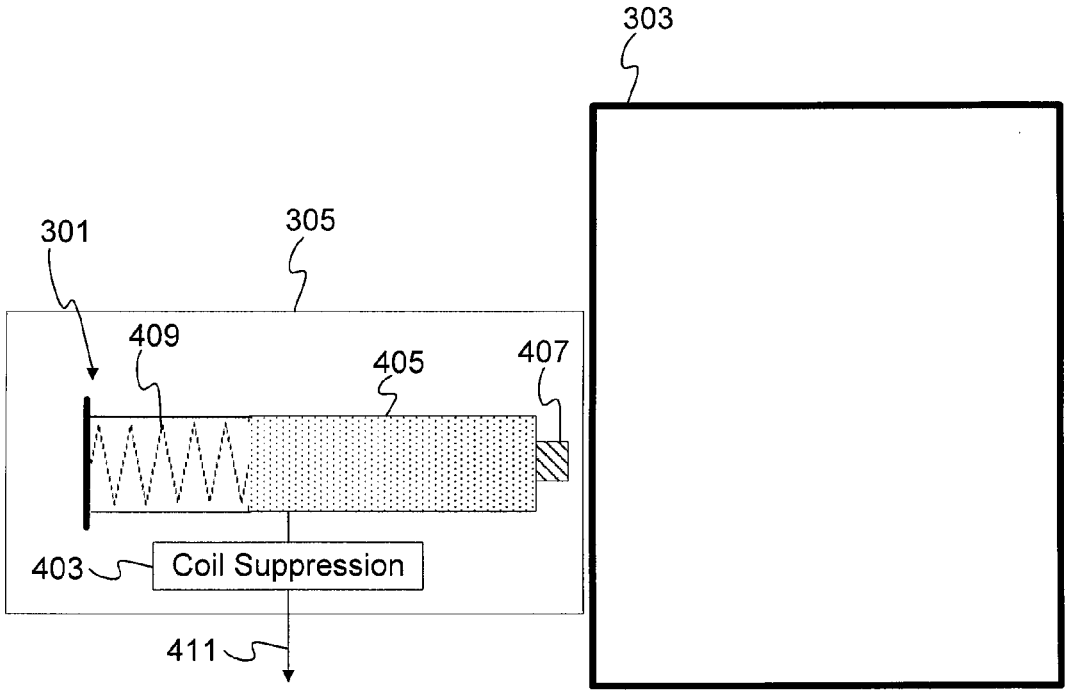
FIG. 4A illustrates the door lock of FIG. 3 in an unlocked state.
Figure 4B:
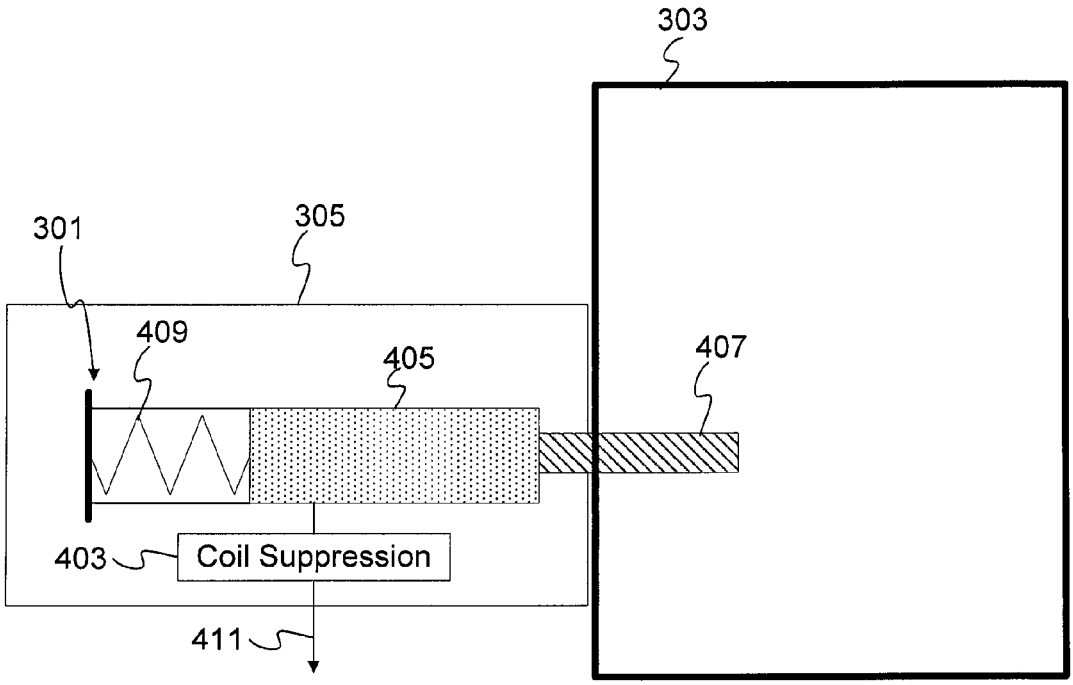
FIG. 4B illustrates the door lock of FIG. 3 in a locked state.

FIG. 4A illustrates door lock 301 in an unlocked state, and FIG. 4B illustrates door lock 301 in a locked state. Door lock 301 of door 305 includes a solenoid 405, a spring 409, and a coil suppression device 403. Solenoid 405 includes a coil of wire producing a magnetic field when it is energized. Plunger 407 receives a force from the magnetic field produced by solenoid 405.

In the example shown in FIG. 4A, the magnetic force pulls the plunger inside the solenoid 405. In this way, the energized state of the solenoid 405 results in an unlocked door 305. A force opposite to the magnetic field is applied to the plunger 407 by spring 409. In other applications, the magnetic force from the solenoid will be applied to force the plunger to the locked position and a spring would apply an opposing force tending to urge plunger to the unlocked position.

A power signal having a supply voltage is delivered by communication line 411. Coil suppression device 403 protects other elements of the circuit from the transient voltage caused by the induced voltage in the solenoid and slows the decay of the magnetic field. This delay allows the plunger to remain in the locked position for an amount of time after the supply voltage is removed. As described above in regards to the door open, the power supply could be switched off for brief periods of time without a change in the state of the door latch. The power supply could then be used to sequentially, or otherwise, power other devices. Coil suppression device 403 may be a diode reversed biased by the supply voltage.

Figure 5:
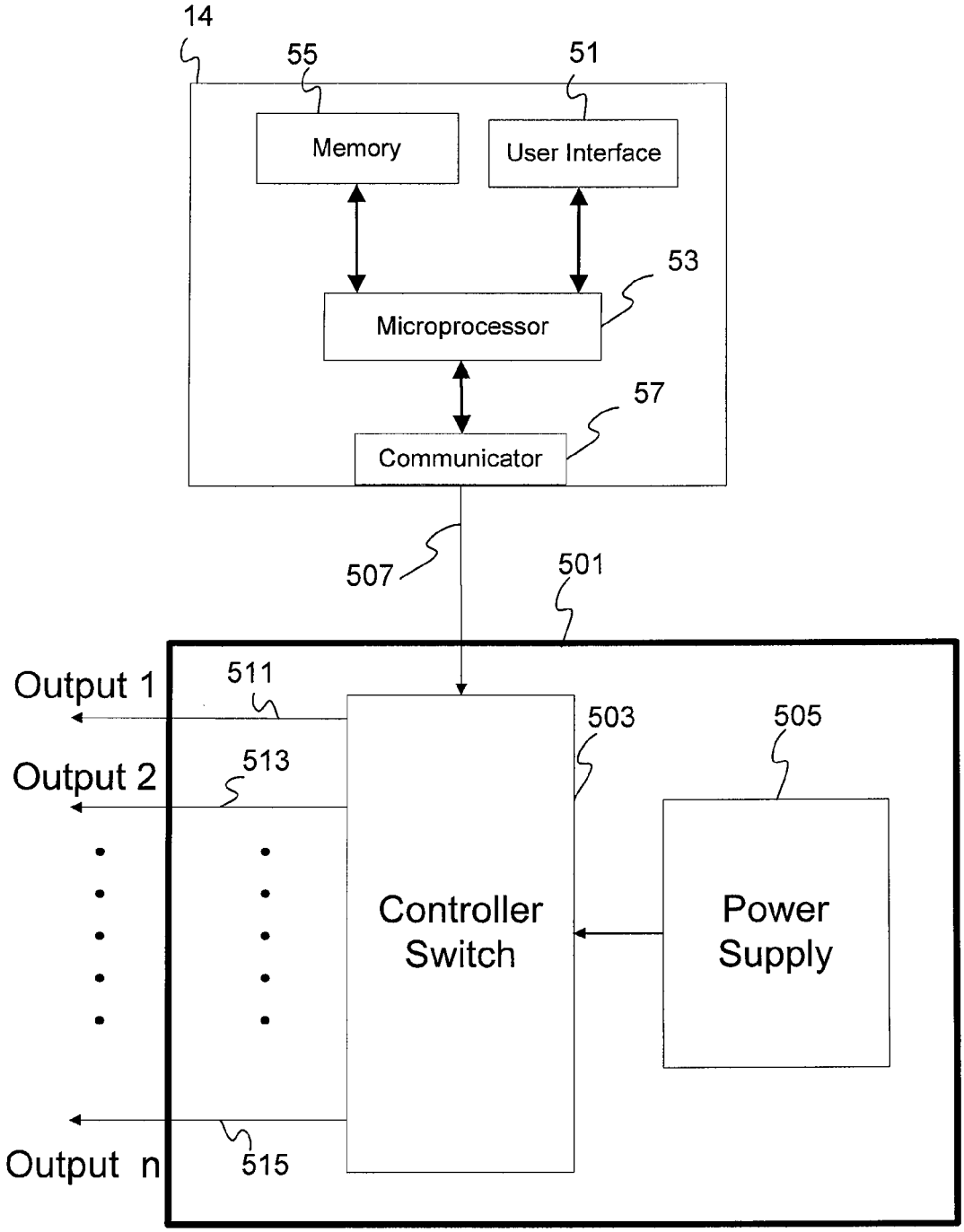
FIG. 5 illustrates a magnetic releasing and securing controller in communication with a control panel.

FIG. 5 illustrates a magnetic releasing and securing controller 501 in communication with a control panel 14. Magnetic releasing and securing controller 501 operates electromagnetic latches, for example the electromagnetic door holders of FIGS. 1 and 2, the door locks of FIGS. 3 and 4, or combinations thereof. The magnetic releasing and securing controller 501 includes a power supply 505, controller switch 503, input communications line 507, and output communication lines 511, 513, and 515 connected to output ports of the magnetic releasing and securing controller. The magnetic releasing and securing controller 501 may be implemented as a microcontroller, integrated circuit, or hardwired logic.

Power supply 505 supplies, via controller switch 503, the power signal having the supply voltage that is in communication with, for example, the electromagnetic door holders of FIGS. 1 and 2 by way of communication lines 201, or the door locks of FIGS. 3 and 4 by way of communication lines 411. The power supply 505 may also be a variable output power supply. The output of the power supply 505 is coupled to the controller switch 503. Additionally, the power supply 505 may be configured to receive a control signal from the controller switch 503 to set the supply voltage and current.

Controller switch 503 alternates the power signal among two or more electromagnetic latching devices. The supply voltage is applied to a first electromagnetic latching device via output communication line 511 for a first time period. The supply voltage is at a level and duration sufficient for electromagnet 109 to hold door 103 open or sufficient for solenoid 405 of lock 301 to unlock door 303. Once the electromagnet or solenoid is activated, less energy is required to maintain the state of the device.

Next, controller switch 503 will switch the supply voltage to a second electromagnetic latching device via output communication line 513. Again the supply voltage is at a level and duration sufficient for electromagnet 115 to hold door 105 open or sufficient for a solenoid of lock 302 to unlock door 307. Once the electromagnet or solenoid is activated, controller switch 503 will alternate back to powering the first electromagnetic latching device. This process continues until an alarm condition is received from input communication line 507.

While two latching devices are discussed with respect to FIG. 5, controller switch 503 may alternate the power signal among any number of electromagnetic latching devices. Further, the electromagnetic latching devices may all be electromagnetic door holders, all door locks, or any combination thereof, as well as other electromagnetic devices. Each of output communication lines 511, 513, and 515 are represented by a single line but may comprise both a positive lead and negative lead. Switching or alternating of the power signal may be done on the positive lead or the negative lead. The switch controller 503 may include any type of appropriate switch. For example, a field effect transistor (FET), bipolar junction transistor (BJT), or relay may be used.

In addition to alternating the power signal among two or more outputs, the controller switch 503 may switch to a lower voltage. As addressed above, electromagnetic latching devices require more energy to activate the magnetic field in the electromagnet or solenoid than to maintain the magnetic field. Therefore, the power supplied to an electromagnetic latching device may be lowered after the magnetic field has been activated, without permitting the magnetic field to decay.

After activating the magnetic field in electromagnet 109 or solenoid 405, the supply voltage of the power signal may be lowered. For example, that lowered supply voltage may be approximately 50% of the original voltage or in the range of 40% to 90% of the original voltage. In this way, two or more electromagnetic latching devices operate using less power.

Some electromagnetic latching devices may have characteristics such that they perform better using either the time slice method that alternates the power signal among two or more devices, while other electromagnetic latching devices may have characteristics that perform better using a lowered supply voltage after activation. In one embodiment, the magnetic releasing and securing controller 501 may be configured to perform both the alternating power signal and the reduced supply voltage procedures. Controller switch 503 may be configured to select either of the procedures based on a control signal from communication line 507. Alternately, controller switch 503 may select either the alternating power signal mode or a reduced supply voltage for operation of the releasing controller 501. Additionally, the controller switch 503 may select the alternating power signal mode for a group of outputs and the reduced power supply voltage for another group of outputs.

Although not shown, a manual external switch, selector, or jumper associated with each of the output communication lines 511, 513, and 515 may be included to permit a user to select either the alternating power signal mode or the reduced supply voltage mode for each of output communication lines 511, 513, and 515.

Magnetic releasing and securing controller 501 may be in communication with a fire alarm control panel 14 by way of communication line 507. Fire alarm control panel 14 coordinates the various components of a fire alarm system, including detectors, manual alarm triggers, notification appliances, and electromagnetic latching devices. Fire alarm control panel 14 may be implemented as hardware or as software executed on a computer. Fire alarm control panel 14 may send a control signal to the magnetic releasing and securing controller 501 indicative of an alarm condition, and the controller switch 503 may switch the power signal off to all or a group of electromagnetic latches based on the control signal. Alternatively, magnetic releasing and securing controller 501 may be integrated with fire alarm control panel 14.

Fire alarm control panel 14 includes user interface 51, memory 55, and microprocessor 53, and communicator 57. Microprocessor 53 receives instructions stored in memory 55 and receives commands or instructions from user interface 51. User interface 51 is a keyboard or other input device configured to allow a user or a computer to enter commands to the control panel 14. Microprocessor 53 may also receive instructions and commands from a removable medium. Fire alarm control panel 14 may generate the control signal to select either the alternating power signal mode or a reduced supply voltage for operation of the releasing and securing controller 501.

Communication line 507 may be part of a network for carrying communication signals within the fire alarm system. Magnetic releasing and securing controller 501 can be addressable on the network by the fire alarm control panel 14. The communication signals can, for example, be multiplexed onto the device's power line—this provides the added benefit that it saves the cost of additional wiring to devices. See for example, U.S. Pat. No. 6,426,697, incorporated by reference herein in its entirety. Alternatively, the communication line to the device may be separate from the power line. The communications channel may comprise, for example, a wired link using the twisted pair technique or a two-wire or three-wire connection using the RS-232 standard. Alternatively, the communication channel may comprise a wireless link using radio, an infrared link, or a fiber optic link. Communicator 57 is configured to send and receive commands and/or data from the network. Communicator 57 includes a network interface as well as the decoding circuitry and amplification circuitry necessary for communication on network 16.

Fire alarm control panel 14 may be embodied on a personal computer, and the functions of the control panel may also be embodied on software. Fire alarm control panel 14 may also include a modem or network interface card configures to communicate with an intranet computer network or with the Internet.

Figure 6A:
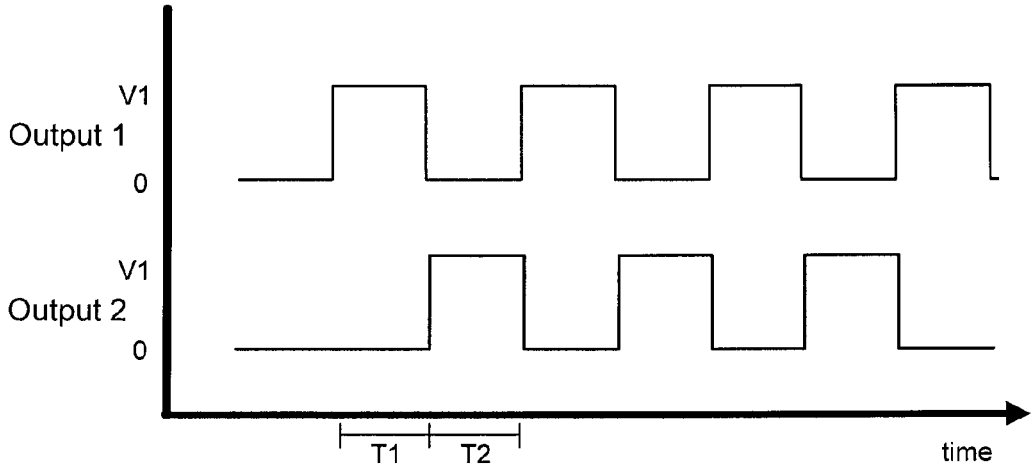
FIG. 6A illustrates a timing diagram for an exemplary implementation of the controller of FIG. 5.

FIG. 6A illustrates a timing diagram for the case when controller switch 503 alternates the power signal between two electromagnetic latching devices. During the first time period T1, controller switch 503 supplies the power signal to Output 1. The first time period T1, begins when V1 is applied to Output 1. During the second time period T2, controller switch 503 supplies the power signal to Output 2. The timing diagram of FIG. 6A represents the timing of the power signal, and does not necessarily represent the power signal itself. The power signal may be direct current (DC) or alternating current (AC).

While FIG. 6A shows first time period T1 equal to second time period T2, the time periods may be set based on the particular characteristics of the electromagnetic latching devices. The rate of decay of the magnetic field of the electromagnetic latching may vary from device to device. Controller switch 503 may be configured to variably adjust time periods T1 and T2 may be varied to account for the variations in the characteristics among the electromagnetic latching devices. The first time period for each output may be longer in duration than all other subsequent time periods to that device to establish the initial magnetic field after the field has dissipated.

Figure 6B:
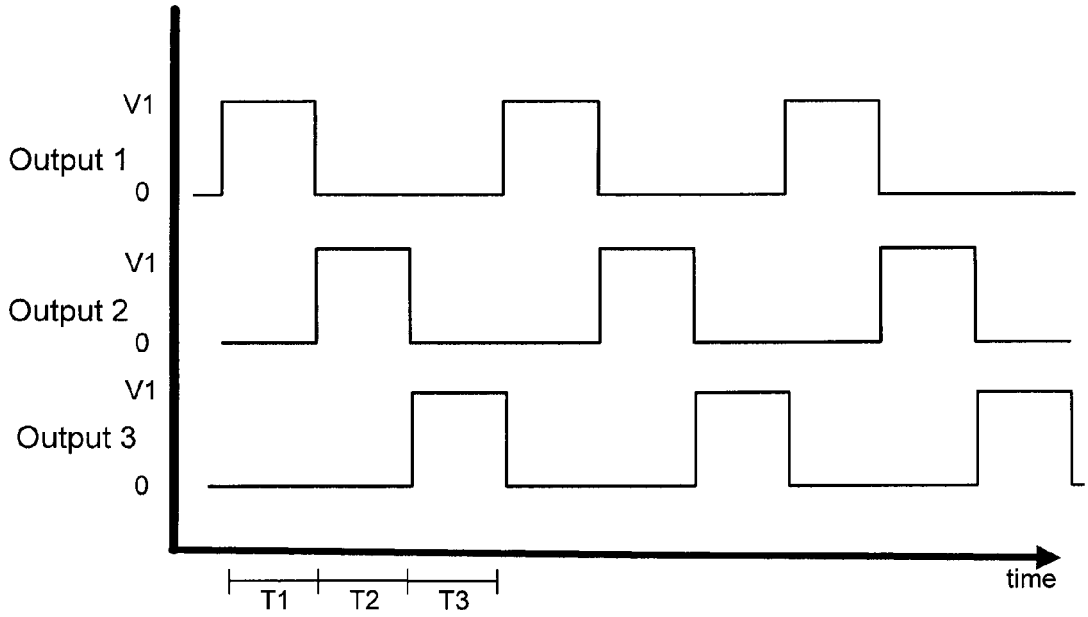
FIG. 6B illustrates another timing diagram for an exemplary implementation of the controller of FIG. 5.

FIG. 6B illustrates a timing diagram for the case when controller switch 503 alternates the power signal among three electromagnetic latching devices using three repeating time periods, T1, T2, and T3. By alternating the power signal among two or more electromagnetic latching devices, power consumed by the system is conserved. In one example, the supply voltage of the power signal for the electromagnetic latching systems including magnetic door holders or electromagnetic locks may be 12 V or 24 V. In this example alternating power among three electromagnetic latching devices, each electromagnetic latching device may be rated at 2 amperes. By energizing each electromagnetic latching device for 10 milliseconds and then not energizing the electromagnetic latching device for 20 milliseconds, a single power supply can now support 6 amperes load of the electromagnetic latching device.

Figure 7:
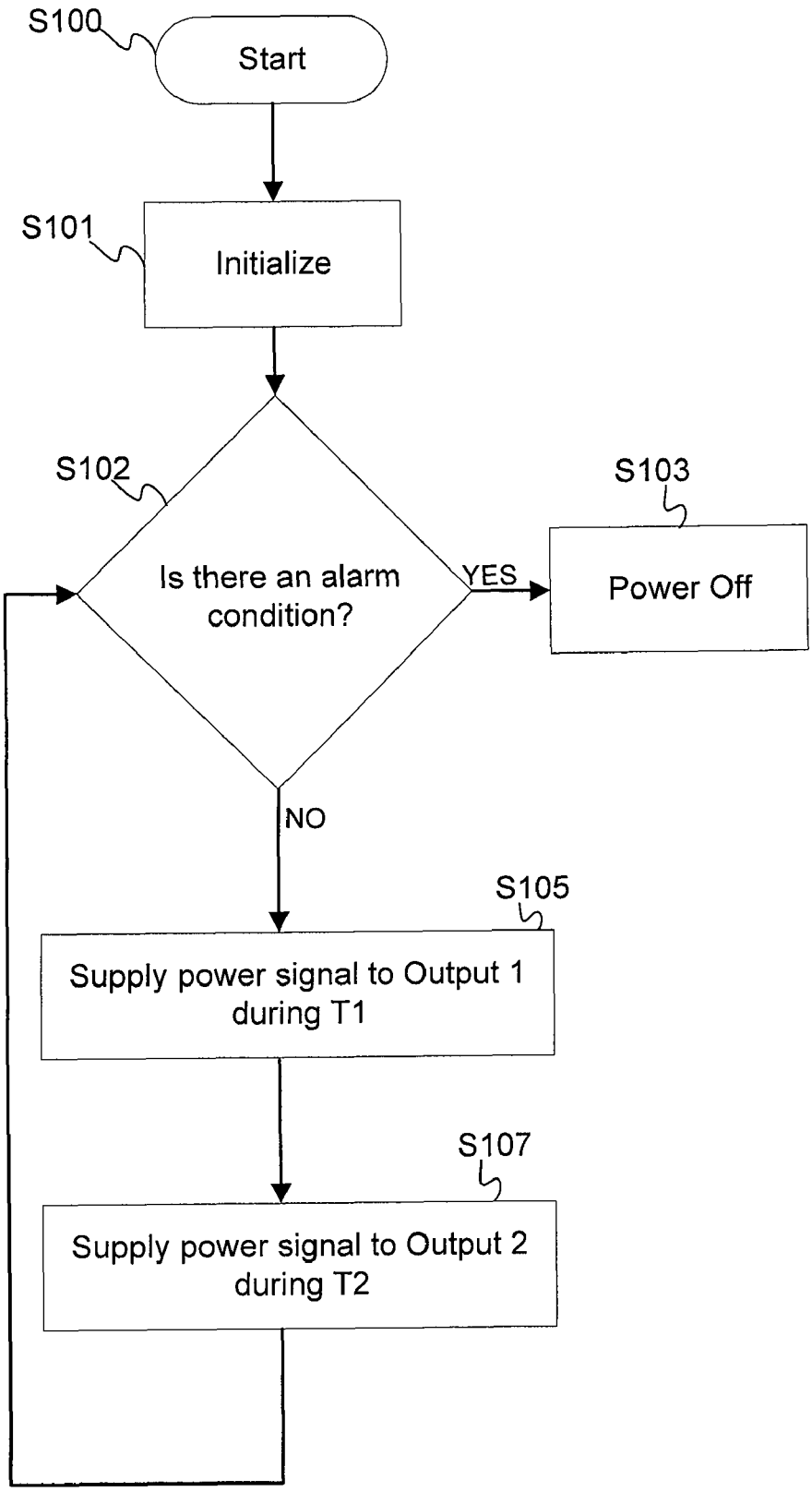
FIG. 7 is a flowchart of a sequence of the magnetic releasing and securing controller in the implementation of FIG. 6A.

FIG. 7 illustrates a flow chart for the operation of magnetic releasing and securing controller in the case of two electromagnetic latching devices. Block S100 indicates the start of the operation of the magnetic releasing and securing controller. At block S101, the controller is initialized to a default state. At block S102, controller switch 503 checks for an indication of an alarm condition from input communications line 507. If there is an alarm condition, controller switch 503 cuts power to all output communication lines. If there is not an alarm condition, controller switch 503 alternates or strobes power between the first and second electromagnetic latching devices. At block S105, controller switch 503 supplies the power signal to Output 1 for time period T1, which corresponds to the first electromagnetic latching device. At block S107, controller switch 503 supplies the power signal to Output 2 for time period T2, which corresponds to the second electromagnetic latching device. The procedure then returns to block S101 and repeats.

Although specific embodiments of the invention have been described and illustrated, the invention is not to be limited to the specific forms or arrangements of parts so described and illustrated. The scope of the invention is to be defined by the claims appended hereto and their equivalents. It is intended that the foregoing detailed description be understood as an illustration of selected forms that the invention can take and not as a definition of the invention. It is only the following claims, including all equivalents, that are intended to define the scope of this invention.

What is claimed is:

1. A system for securing and releasing doors, the system comprising:

a first electromagnetic latch for securing and releasing a first door, the first electromagnetic latch including a first coil configured to be energized by a power signal to create a first magnetic field; to maintain the first electromagnetic latch in either a locked or unlocked state;

a second electromagnetic latch for securing and releasing a second door, the second electromagnetic latch including a second coil configured to be energized by the power signal to create a second magnetic field to maintain the second electromagnetic latch in either a locked or an unlocked state; and a controller operable to apply the power signal sequentially to the first electromagnetic latch and the second electromagnetic latch such that the power signal energizes only the first coil during a first time period and energizes only the second coil during a second time period while each of the first and second electromagnetic latches continue to maintain either the locked or unlocked state.

2. The system of claim 1, wherein the first electromagnetic latch is an electromagnetic door holder configured to hold the first door open by applying the first magnetic field to a magnetic member mounted on the first door.

3. The system of claim 2, wherein the magnetic member is released from the electromagnetic door holder when the first coil is not energized by the power signal for a time period greater than the second time period.

4. The system of claim 1, wherein the first electromagnetic latch is a solenoid configured to operate a lock on the first door.

5. The system of claim 4, wherein the solenoid is configured to hold the lock in an unlocked position by applying the first magnetic field.

6. The system of claim 4, wherein the solenoid is configured to release the lock to an unlocked position when the solenoid is not energized by the power signal for a third time period greater than the second time period.

7. The system of claim 1, further comprising:

a coil suppression diode coupled to the first coil to supply an induced voltage to the first coil during the second time period in a direction opposite to a direction of current from the power signal.

8. The system of claim 1, wherein the controller is configured to operate in a first mode in which the controller applies the power signal between a first output port during the first time period and a second output port during the second time period, and a second mode in which the controller applies the power signal to the first output port and the second output port during a third time period and a reduced power signal to the first output port and the second output port subsequent to the third time period.

9. The system of claim 1, wherein the controller is configured to receive a control signal indicative of an alarm condition from a fire alarm control panel and switch off the power signal based on the control signal.

10. A magnetic releasing and securing device controller comprising:

a first output port electrically coupled to a first coil of a first electromagnetic latch for securing and releasing a first door; in a locked or unlocked state of the first electromagnetic latch;

a second output port electrically coupled to a second coil of a second electromagnetic latch for securing and releasing a second door; and in a locked or unlocked state of the second electromagnetic latch;

a controller switch configured to apply the power signal to the first electromagnetic latch and the second electromagnetic latch such that the power signal energizes only the first coil during a first time period and energizes only the second coil during a second time period while each of the first and second electromagnetic latches continue to maintain either the locked or unlocked state.

11. The controller of claim 10, wherein the first electromagnetic latch is a first electromagnetic door holder configured to secure and release a first door and the second electromagnetic latch is a second electromagnetic door holder configured to secure and release a second door.

12. The controller of claim 11, wherein the first electromagnetic latch releases the first door when it is not energized by the power signal for a time period greater than the second time period and the second electromagnetic latch releases the second door when it is not energized by the power signal for a time period greater than the first time period.

13. The controller of claim 10, wherein the first electromagnetic door latch comprises a first solenoid which drives a first door lock and the second electromagnetic door latch comprises a second solenoid which drives a second door lock.

14. The controller of claim 10, wherein the first electromagnetic door latch comprises a solenoid which drives a door lock and the second electromagnetic door latch comprises an electromagnetic door holder.

15. The controller of claim 14, further comprising:

a third output port electrically coupled to a third coil of a third electromagnetic latch for securing and releasing a third door;

wherein the controller switch is further configured to switch the power signal such that the power signal energizes only the third coil during a third time period.

16. The controller of claim 10, wherein the controller switch is configured to operate in a first mode in which the controller switches the power signal between the first output port during the first time period and the second output port during the second time period, and a second mode in which wherein the controller applies the power signal to the first output port and the second output port during a third time period and a reduced power signal to the first output port and the second output port subsequent to the third time period.

17. The controller of claim 10, wherein the first output port is electrically coupled to the first coil by a wired connection including a negative lead and a positive lead, wherein a coil suppression diode is biased from the negative lead to the positive lead to provide a path for a current induced in the first coil during the second time period.

18. The controller of controller 10, wherein the controller switch is configured to receive a control signal indicative of an alarm condition from a fire alarm control panel and switch off the power signal based on the control signal.

19. A method of releasing and securing doors, the method comprising:

supplying a power signal to a first coil of a first electromagnetic latch for securing and releasing a first door; by maintaining the first electromagnetic latch in a locked or unlocked state;

supplying the power signal to a second coil of a second electromagnetic latch for securing and releasing a second door; and by maintaining the second electromagnetic latch in a locked or unlocked state;

switching the power signal between the first electromagnetic latch and the second electromagnetic latch such that the power signal energizes only the first coil during a first time period and energizes only the second coil during a second time period to continue to maintain the first electromagnetic latch in either the locked or unlocked state and the second electromagnetic latch in either the locked or unlocked state.

20. The method of claim 19, wherein the first electromagnetic latch is an electromagnetic door holder configured to hold the first door open by applying a magnetic field to a magnetic member mounted on the first door.

21. The method of claim 19, wherein the first electromagnetic latch is a first solenoid configured to operate a lock on the first door and the second electromagnetic latch is a second solenoid configured to operate a lock on the second door.

22. The method of claim 19, wherein the first electromagnetic latch is an electromagnetic door holder configured to hold the first door open by applying a magnetic field to a magnetic member mounted on the first door and the second electromagnetic latch is a solenoid configured to operate a lock on the second door.

23. The method of claim 19, further comprising:

receiving a control signal indicative of an alarm condition from a fire alarm control panel; and switching off the power signal to both the first coil and the second coil based on the control signal.

* * * * *

UNITED STATES PATENT AND TRADEMARK OFFICE

CERTIFICATE OF CORRECTION

PATENT NO. : 8,231,151 B2
APPLICATION NO. : 12/437428
DATED : July 31, 2012
INVENTOR(S) : Barrieau It is certified that error appears in the above-identified patent and that said Letters Patent is hereby corrected as shown below:

Claim 1
Col. 7, Line 6
Whereas, "...create a first magnetic field; to maintain..." should read
"...create a first magnetic field to maintain..."

Claim 10
Col. 8, Line 5
Whereas, "...door; in a locked..." should read "...door in a locked..."

Col. 8, Line 9
Whereas, "...a second door; and in a locked..." should read "...a second door in a locked..."

Claim 19
Col. 9, Line 4
Whereas, "...releasing a first door; by..." should read "...releasing a first door by..."

Col. 10, Line 9
Whereas, "...door; and by maintaining..." should read "...door by maintaining..."

Col. 10, Line 10
Whereas, "...locked or unlocked state;..." should read "...locked or unlocked state; and..."

Signed and Sealed this
Second Day of October, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,231,151 B2
APPLICATION NO. : 12/437428
DATED : July 31, 2012
INVENTOR(S) : Barrieau It is certified that error appears in the above-identified patent and that said Letters Patent is hereby corrected as shown below:

Column 9
Claim 19
Line 4

"magnetic latch for securing and releasing a first door; by"

should be corrected to read:

"magnetic latch for securing and releasing a first door by"

Signed and Sealed this
Twenty-third Day of October, 2012

David J. Kappos
*Director of the United States Patent and Trademark Office*